United States Patent [19]

Mezereny et al.

[11] 3,977,049

[45] Aug. 31, 1976

[54] BELT BUCKLE

[76] Inventors: Eugene Mezereny; Ilona C. Mezereny, both of 509 Indiana Court, South Pasadena, Calif. 91030

[22] Filed: Aug. 20, 1973

[21] Appl. No.: 389,478

Related U.S. Application Data

[63] Continuation of Ser. No. 153,967, June 17, 1971, abandoned.

[52] U.S. Cl. ..... 24/77 R; 24/163 R; 24/168

[51] Int. Cl.[2] ..... A44B 11/25

[58] Field of Search ..... 24/198, 199, 200, 77 S, 24/169, 170, 163 R, 75, 77 R, 168

[56] References Cited

UNITED STATES PATENTS

| | | | |
|---|---|---|---|
| 687,919 | 12/1901 | Fairbrother | 24/75 |
| 1,361,921 | 12/1920 | Stevens | 24/198 |
| 1,516,462 | 11/1924 | Schvarcz | 24/75 |
| 1,904,055 | 4/1933 | King | 24/77 S |
| 2,123,773 | 7/1938 | Eppink | 24/198 |
| 2,231,259 | 2/1941 | Elwell | 24/200 |
| 2,292,899 | 8/1942 | Sanford | 24/198 |
| 3,085,308 | 4/1963 | White | 24/200 |
| 3,495,305 | 2/1970 | Mezerenyi et al. | 24/77 R |

FOREIGN PATENTS OR APPLICATIONS

| | | | |
|---|---|---|---|
| 1,225,806 | 7/1960 | France | 24/169 |

*Primary Examiner*—Roy D. Frazier
*Assistant Examiner*—Darrell Marquette

[57] ABSTRACT

Detachable slotted outer and inner hooking buckle members are mounted on opposite ends of a belt for hooking the belt ends together. One side of each slot is manually settably adjustable to vary the width of the slots of the outer member to accommodate belts of various thicknesses passing through the slots while at the same time providing frictional engagement between sides of the slot and the belt.

4 Claims, 16 Drawing Figures

FIG.1.
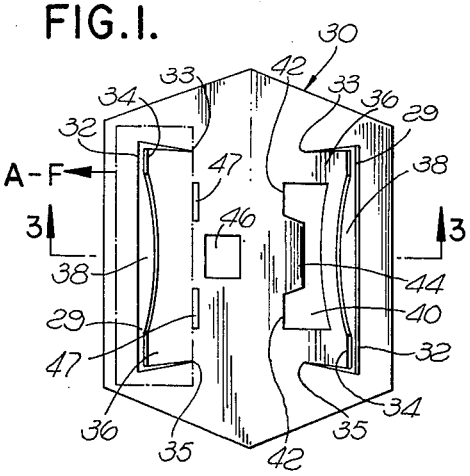
FIG.2.
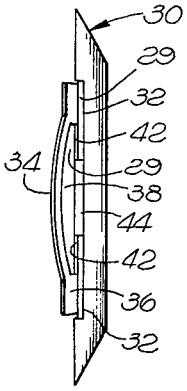
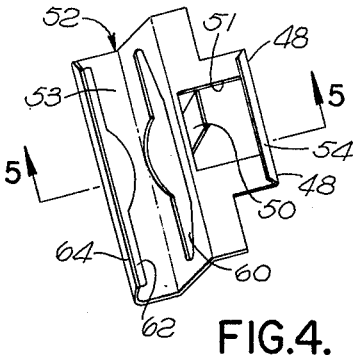
FIG.4.
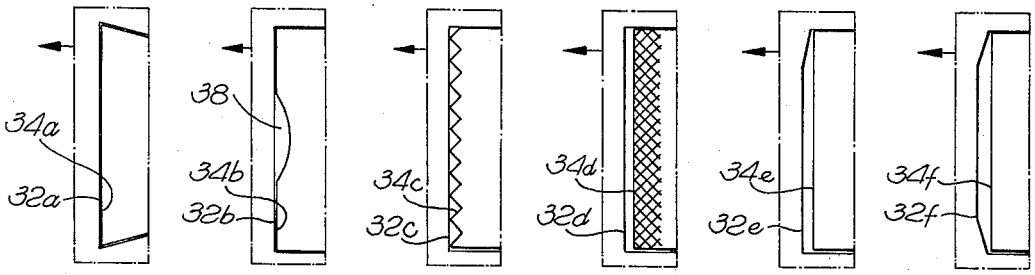
FIG.1a. FIG.1b. FIG.1c. FIG.1d. FIG.1e. FIG.1f.
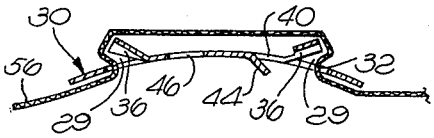
FIG.3.
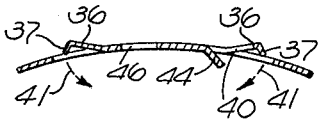
FIG.3a.
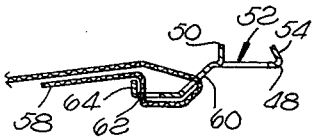
FIG.5.
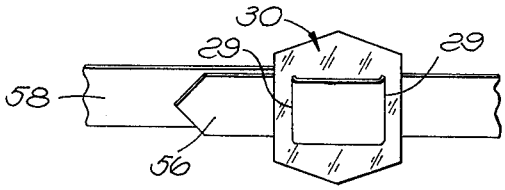
FIG.6.
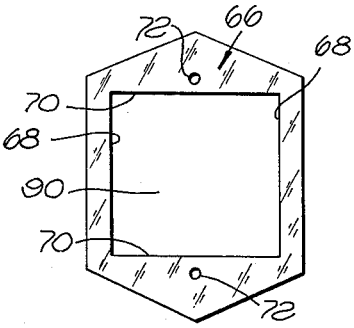
FIG.7.
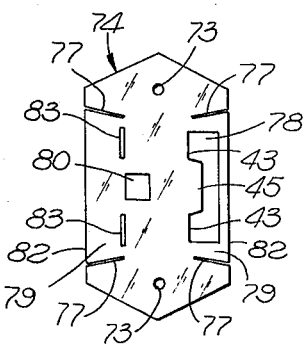
FIG.8.
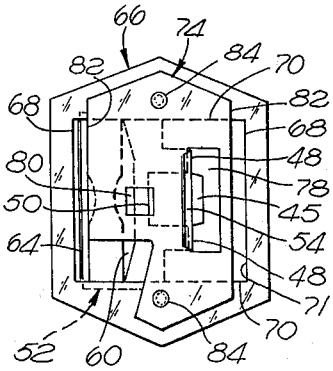
FIG.9.

BELT BUCKLE

REFERENCE TO RELATED APPLICATION

This application is a continuation of copending United States patent application Ser. No. 153,967, filed June 17, 1971, and now abandoned entitled "Belt Buckle."

BACKGROUND OF THE INVENTION

This invention is an improvement over the belt buckles of U.S. Pat. Nos. 3,252,191 and 3,495,305 which have an outer slotted member provided with specially shaped slots adapted to be attached to one end of the belt and an inner slotted connecting member adapted to be attached to the other end of the belt and to hook onto the outer member. In order to accommodate various belt thicknesses, the members of such buckles were provided with slots of standard width capable of passing through the thickest anticipated belt material. In order to employ these members with belts of thinner material, the wedges shown in the 3,495,305 patent had to be used. Not only is this extra wedge piece an inconvenience to the user but a problem is also presented in determining the exact wedge necessary in order to arrive as nearly as possible at a combination which will be usable with the belt thickness most likely to be employed. In addition, the small amount of frictional contact provided by the two legs of the wedge will not satisfactorily secure belts of certain thin materials to the buckle member.

Furthermore, the two members of such prior buckles could rotate with respect to each other after hooking together, thus presenting an undesirable appearance and the possibility that the two members might even become unhooked.

To attain the desired slot width for accommodating various different belt thicknesses and materials, at least a portion of the buckle of the present invention is composed of a non-resilient material of a construction capable of being bent and set into new positions by hand to form slots having various widths until a similar or greater force is applied to change the slot width.

SUMMARY OF THE INVENTION

A belt buckle is provided having an outer member and an inner connecting member adapted to be secured to opposite ends of the belt and connected together. A slot formed in the outer member has one side which is manually settably adjustable to vary the width of the slot to allow belts of different thicknesses to pass through the slot while at the same time maintaining frictional engagement between the sides of the slot and the belt.

In one embodiment of the invention, a slot is provided at each of two opposite ends of the outer member with flaps forming the one adjustable side of each slot. The buckle is composed of a non-resilient metal and the flaps are pivotally adjustable about their inner ends connected to the outer member. The slot widths are adjusted by manually bending the flaps from the plane of the outer member. This bending is facilitated by weakening apertures provided in the outer member on the pivot line of each flap. Each slot has a widened portion to allow thicker parts of the belt to pass eaily through the slot while the narrower portions of the slot maintain frictional engagement with the belt. A tongue protrudes from one side of a first aperture formed between the slots with that one side of the aperture providing shoulders on either side of the tongue. A double short hook joined by a bar of the inner connecting member hooks over the shoulders of the first aperture on opposite sides of the tongue to connect the outer and inner members together. A lug protruding from the inner connecting member fits inside a second aperture in the outer member when the members are hooked together to prevent rotation of the two members relative to each other.

Thus, a belt buckle is provided which is settably adjustable for use with belts of varying thicknesses and which by means of a three point hooking connection prevents relative rotation of the buckle parts. Such a buckle provides sufficient frictional contact to hold even the thinnest of belts.

BRIEF DESCRIPTION OF THE DRAWINGS

FIG. 1 is a plan view of the outer member of one embodiment of the invention;

FIGS. 1A through 1F are partial plan views showing various configurations for the area A–F of FIG. 1 before the flaps are bent outwardly from the plane of the outer member;

FIG. 2 is a side view of the outer member of FIG. 1 looking from the right side of FIG. 1;

FIG. 3 is a cross sectional elevational view taken along the line 3—3 of FIG. 1 with a belt inserted;

FIG. 3A is a cross sectional elevational view of the outer member of another embodiment of this invention;

FIG. 4 is a perspective view of the inner connecting member of one embodiment of this invention;

FIG. 5 is a cross sectional elevational view taken along the line 5—5 of FIG. 4 with a belt inserted;

FIG. 6 is a perspective view of the inner and outer members of one embodiment of this invention secured to a belt and hooked together, the inner member being hidden by the outer member;

FIG. 7 is a plan view of the outer frame part of the outer member of another embodiment of this invention;

FIG. 8 is a plan view of the inner plate part of the outer member to be employed with the outer frame shown in FIG. 7; and FIG. 9 is a plan view of an outer frame and inner plate of FIGS. 7 and 8 assembled to form the outer member and showing the inner connecting member of FIG. 4 in hooked position.

DESCRIPTION OF THE INVENTION

The outer member 30 shown in FIG. 1 is preferably formed from a single plate of non-resilient metal, such as aluminum, brass, stainless steel or some other material which may be made manually bendable and settable as will be explained hereinafter. The member 30 is arched slightly, as is shown in FIG. 3. The thickness of the outer member 30 is cut through to define flanges or flaps 36. These flaps are preferably bent outwardly from the plane of the outer member by rotating them about a line connecting the termination points 33 and 35 of the cut to form two slots 29. The elongated slots 29 are bound on their longitudinal sides by inner edges 34 of the flaps and by the edges 32 of the outer member 30.

The flaps 36 are made bendable so that they can be moved either outwardly or inwardly to adjust the width of the slots 29 to allow the passage of belts of different thicknesses while still maintaining frictional contact between the belt and the slot sides to secure the member 30 to the belt, as will be explained hereinafter. In this manner, the width of the slots may be set as desired for a particular thickness belt material. When another thickness of belt is to be employed, the flaps are merely bent into a new position, thus resetting the width of the slots accordingly. This settable characteristic allows the easy insertion and removal of belts through the slots. Weakening apertures or slots 47 are provided adjacent one or both of the lines between points 33 and 35 where necessary to facilitate manual bending adjustment and setting of the flaps 36 with a pliers, screwdriver or other normal household tools.

The flaps, when set in their new position, will withstand the relatively smaller bending forces incurred during wearing caused by tension of the belt and thus maintain their previously set position.

To provide means for easy insertion of thicker portions of a belt, such as the nose portion where folds of the belt come together to form a point, the central portion of the flaps 36 may be bent outwardly, as shown in FIGS. 1–3, to form wider portions or enlargements 38 of the slots 29. FIG. 2 is a side view of the outer member 30 looking from the right side of FIG. 1 between the plane of the flaps 36 and the plane of the remainder of the arched member 30. The portions of the edges 32 of the slots which are not bent to form enlargements 38 will cooperate with slot edges 34 to maintain frictional engagement with the belt to secure the member 30 to the belt as is shown in FIGS. 2 and 3. It will be apparent that one portion of a flap, such as an end, may be bent more than the rest to conform to different thicknesses of the same belt.

FIGS. 1A–1F show examples of various shapes of slots and flaps which may be employed in place of the flaps shown in FIG. 1. In these six figures the flap has been cut but has not yet been bent from the plane of the outer member 30. In FIG. 1A the edge 32*a* of the plate and edge 34*a* of the flap 36 are parallel, which is the basic shape employed to construct the flaps and slots of FIG. 1 before the flaps are adjusted and the central portions of the flaps bent to provide enlargements 38. The sides of the flaps are cut inwardly so that the lines about which the flaps pivot are shorter than the edge 34*a*. In FIG. 1B a piece of the outer member is removed, such as by punching out part of the flange, to provide enlargement 38. In FIG. 1C the flange edge 34*c* is serrated to provide greater belt retention. The shapes of FIGS. 1D–1F are preferably made by punching out the buckle material between the edges 32 and 34. To increase the frictional force between the belt and flap, the flap may have knurls 31 formed on the surface contacting the belt, as indicated in FIG. 1D.

The hooking portion of the outer slotted member 30, together with the inner connecting member 52, prevents relative rotation of the two members while at the same time hooking the belt ends together. A tongue 44 protrudes into an opening or aperture 40 from the central part of the interior edge of aperture 40 of outer member 30. The transverse interior edges on opposite sides of tongue 44 provide shoulders 42 for a purpose which will be explained hereinafter. The tongue 44 may remain in the plane of the member 30 but is preferably bent inwardly in a direction towards the position which the inner connecting member 52 will assume when the members 30 and 52 are hooked together. Where aperture 40 is formed in a flap 36, as in FIG. 1, additional weakening apertures 47 may not be necessary to facilitate bending.

Opening 46 near the central portion of outer member 30 receives lug 50 of inner connecting member 52, as will be explained hereinafter. The front edge (nearest tongue 44) and the opposed back edge of opening 46 are spaced apart by an amount sufficient to allow the lug 50 to pass between them at an angle. Top and bottom edges of opening 46 are spaced apart an amount slightly greater than the width of lug 50.

FIG. 3 illustrates in cross section the outer buckle plate 30 of FIG. 1 with a belt 56 inserted from the inner surface of the outer member 30, through the first slot 29 nearest aperture 40, over the flaps 36 and out through the second slot 29.

FIG. 3A shows another variation of the outer member 30 having a portion of the flaps punched out, as in FIG. 1D, with the knurls 31 on the top surface of the flaps 36. Inwardly bent portions 37 along the edges 34 of the flaps allow this outer member to be employed with belts made of heavy, thick material, such as leather, plastic, and the like, which do not vary in thickness and which can withstand sharp bending. Such belts appear very bulky when used with the outer member shown in FIG. 3, but inwardly bent portion 37 of FIG. 3A reduces the height of flaps 36 and makes the bending of heavy belts smoother. By bending the entire flaps 36 inwardly past the plane of the buckle, as indicated by the arrows 41, the slots 29 are made even wider allowing smoother bending of such belt materials or the use of even thicker belt materials. The knurled surface on portions 37 increases the frictional force between the belt and the member 30. By bending the flaps back towards the plane of the buckle, narrower slots are formed suitable for maintaining in place belts of a thinner material. Thus, a buckle construction is provided which is suitable for use with a wide variety of belt materials of varying thicknesses.

FIGS. 4 and 5 show one type of inner connecting member 52 that may be employed in this invention. Two slots 60 and 62, separated by a dividing portion 53, allow the belt material 58 to be passed through and thus secured to the inner connecting member 52. These slots have enlarged portions to admit thickened parts of the belt material, as previously discussed. Flange 64 adjacent to slot 62 is bent at a right angle to the plane of slot 62 to provide another line of frictional engagement with belt 58. The hooking means of the member 52 is a combination of two short hooks 48 connected with a lip or bar 54, herein referred to as double short hooks. Protrusion or lug 50 projects upwardly at right angles to the plane of opening 51 between hooks 48 to fit into outer member opening 46.

To secure the inner member to a belt, the belt end 58 is inserted from the outer side first down through inner slot 60, across the inner or back surface of the divider 53, up through the outer slot 62 and over the flange 64 leaving a short end portion for further adjusting the length of the belt. Thicker belts may be inserted in the inner member in a manner similar to that shown for outer member in FIG. 3 by bending the flange 64 inwardly so that the bends between the slots 60 and 62 and between the slot 60 and the projection 50 are sharper.

In connecting the members 30 and 52, the inwardly bent tongue 44 of the outer member guides the bar 54 and the double short hooks 48 of the inner connecting member onto the shoulders 42 on either side of the tongue 44. The lug 50 fits snuggly into opening 46 with one face adjacent to the front edge of opening 46 and the sides of lug closely adjacent to the top and bottom edges of the opening. The engagement of the two hooks 48 with the shoulders 42 and the lug 50 in the opening 46 provides three position coupling between the inner and outer members to prevent disengagement and relative rotation of the two members when they are hooked together and a force is applied tending to pull the two belt ends apart.

The hooks 48 are short, that is, the portion which hooks over shoulders 42 does not push the belt material overlaying outer member 30 outwardly when the outer and inner members are hooked together. Further explanation of the operation of this hooking system in found in U.S. Pat. No. 3,495,305.

As will be apparent from FIG. 5, the overall configuration of the inner member 52 is such that when the inner and outer members are connected to opposite belt ends and hooked around a wearer, the tension on the belt and the support against the back of the inner member provided by the body of the wearer maintains the projection 50 in the opening 46 of the outer member and locks the members together.

In some uses, it may be desirable to make the inner slot 60 of connecting member 52 wider and to eliminate the enlargement since the belt does not bear against one edge of the slot. The flange 64 may have a cogged edge and may be folded inwardly to provide greater frictional contact with the belt and to narow the outer slot 62. Depending on the particular application, the inner member 52 may be bent in various other shapes to accomplish such purposes.

FIG. 6 shows the appearance of a belt from the outside when the belt ends are inserted in the inner and outer members of FIGS. 1 and 5 of this invention and the members are hooked together.

The outer slotted member may be composed of two pieces, such as the outer frame 66 shown in FIG. 7 and the inner plate 74 shown in FIG. 8. The outer frame 66 is similar to the outer member 30 of FIG. 1 but with the flaps and tongue removed to provide a large rectangular opening 90. Opposed rivet holes 72 in the top and bottom of the frame are provided for securing the inner plate 74 to the frame 66 as is shown in FIG. 9.

The inner plate 74 includes settably adjustable flaps 79 defined by cuts 77. Weakening slots 83 are provided to allow manual adjustability of the flap 79 which does not contain opening 78. Tongue 45 in opening 78 guides the double hooks and connecting bar of a connecting member onto the adjacent shoulders 43 for hooking the outer and inner members together (FIG. 9) as previously described. Opening 80 receives the lug or projection of the inner connecting member to prevent relative rotation of the two members. Rivet holes 73 are aligned with rivet holes 72 when the plate 74 is correctly positioned over frame 66.

The plate and frame are fastened together with rivets 84, as is shown in FIG. 9, to form an outer member with the sides 68 of the opening 90 forming one longitudinal edge of each slot 71 and with parts of the top and bottom sides 70 of opening 90 providing the short edges of slots 71. The sides 82 of the inner plate 74 provide the inner settably adjustable edges of the slots 71. The inner and outer edges of the slots 71 may have different shapes as are shown, for example, in FIGS. 1A–1F.

For buckles made of thick materials, it is desirable to recess the shoulders 43 and tongue 45 inwardly so that the double short hooks do not push outwardly against material overlaying the plate 74. For this purpose, cuts may be made in the plate 74 extending from the outer ends of the shoulders 43 towards the weakening apertures 83 so that the shoulders and tongue may be adjusted inwardly by bending.

Other means, such as grippers, screws or hooks, may be employed to removably secure the plate 74 to frame 66. Such securing means may be attached to the frame 66 shown in FIG. 7 or to frames having different configurations, such as a frame having a cross-bar or divider extending across the middle of the space 90 and parallel to slots 71. Such a cross-bar may also carry various elements of the plate 74, such as the tongue 45 and aperture 80.

If the inner plate 74 is composed of a thinner non-resilient material, the width of the slots 71 may be settably adjusted by bending portions of the plate 74, such as the edges 82, without providing the cuts 77. Alternatively, plates of different widths between edges 82 fitting the same frame may provide different size slots for belts of different thicknesses. The edges of these plates would in effect be settaby adjustable flaps.

Thus, this invention provides a buckle outer member with slots, each slot having one side manually settably adjustable to vary the slot width to accommodate various belt thicknesses while maintaining frictional contact between the belt and the slot edges in order to secure the outer member to the belt.

It will be understood that the disclosed embodiments of this invention are presented by way of preferred examples, but may be modified in various ways with other specific shapes and configurations to be employed with a variety of belt materials and thicknesses.

What is claimed is:

1. A belt buckle having two parts adapted to be secured to opposite ends of a belt, comprising:

an outer buckle member comprising an outer frame and a plurality of innerplates removably attachable to said outer frame, adjacent edges of said outer frame and innerplates providing between them two parallel longitudinal slots adjacent opposite ends of said outer member, each of said plates having a different width thereby providing different slot widths when attached to said frame, said outer frame further comprising:

a first aperture between said slots having a tongue protruding into said aperture, the sides of said aperture forming shoulders on opposite sides of said tongue;

a second aperture adjacent to said first aperture;

an inner connecting member having double short hooks connected by a bar adapted to hook onto said outer member to connect the two members together said inner connecting member further comprising a projecting lug adapted to lodge in said second aperture when said outer and inner members are hooked together to prevent rotation of the two members with respect to each other.

2. A belt buckle having two parts adapted to be secured to opposite ends of the belt, comprising:

an outer member composed of non-resilient material having a pair of adjustable parallel slots formed adjacent to opposite ends of said member, one side of each of said slots being formed by a manually adjustable flap cut in said outer member, each of said flaps being pivotally settable by bending said flap about its inner end connected to said member to vary the width of the respective slots in order to allow passage therethrough of belts of different thicknesses while maintaining frictional contact between the belt and the sides of the slots, each of said slots having a widened portion for insertion therethrough of thickened parts of the belt while the narrower portions of the slots maintain frictional contact with the belt;

a first aperture formed between said slots having a tongue protruding into said aperture, the sides of said aperture forming shoulders on opposite sides of said tongue; and a second aperture formed in said outer member between said two flaps; and an inner connecting member having double short hooks connected by a bar, the curve of the hooks bearing against said shoulders on opposite sides of said tongue when the outer and inner members are hooked together a lug projecting from said inner connecting member adapted to lodge in said second aperture when said outer and inner members are hooked together to prevent rotation of the two members with respect to each other.

3. A belt buckle having two parts adapted to be secured to opposite ends of a belt, comprising:

an outer buckle member comprising an outer frame and an inner plate secured together, said inner plate being composed of a non-resilient manually bendable material, and adjacent edges of said outer frame and said inner plate providing between them two parallel longitudinal slots adjacent opposite ends of said outer member, pivotally adjustable flaps form the edges of the inner plate adjacent each slot to allow settable variation in the width of said slots in accordance with pivotal adjustment of said flaps, and further comprising:

a first aperture formed in said inner plate having a tongue protruding into said aperture, the sides of said aperture forming transverse shoulders on opposite sides of the tongue; and a second aperture formed in said inner plate between said two flaps;

an inner connecting member having double short hooks connected by a bar adapted to hook onto said outer member to connect the two members together said inner connecting member further comprising a projecting lug adapted to lodge in said second aperture when said outer and inner members are hooked together to prevent rotation of the two members with respect to each other.

4. A belt buckle having two parts adapted to be secured to opposite ends of a belt, comprising:

an outer buckle member comprising an outer frame and an innerplate secured together, said inner plate being composed of a non-resilient manually bendable material, and adjacent edges of said outer frame and inner plate providing between them two parallel longitudinal slots adjacent opposite ends of said outer member, further comprising a plurality of inner plates removably attachable to said outer frame, each of said plates having a different width thereby providing different slot widths when attached to said frame, said outer frame further comprising:

a first aperture between said slots having a tongue protruding into said aperture, the sides of said aperture forming shoulders on opposite sides of said tongue;

a second aperture adjacent to said first aperture an inner connecting member having double short hooks connected by a bar adapted to hook onto said outer member to connect the two members together said inner connecting member further comprising a projecting lug adapted to lodge in said second aperture when said outer and inner members are hooked together to prevent rotation of the two members with respect to each other.

* * * * *